US009904201B2

(12) United States Patent
Handa

(10) Patent No.: US 9,904,201 B2
(45) Date of Patent: Feb. 27, 2018

(54) IMAGE FORMING APPARATUS

(71) Applicant: FUJI XEROX CO., LTD., Tokyo (JP)

(72) Inventor: Osamu Handa, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/249,804

(22) Filed: Aug. 29, 2016

(65) Prior Publication Data

US 2017/0212445 A1 Jul. 27, 2017

(30) Foreign Application Priority Data

Jan. 21, 2016 (JP) ..... 2016-009490

(51) Int. Cl.
*G03G 15/00* (2006.01)
*G03G 15/02* (2006.01)
*G03G 15/16* (2006.01)

(52) U.S. Cl.
CPC ..... *G03G 15/0266* (2013.01); *G03G 15/1695* (2013.01); *G03G 15/652* (2013.01)

(58) Field of Classification Search
CPC ..... G02G 15/0266; G02G 15/5062; G02G 15/0194
See application file for complete search history.

(56) References Cited

U.S. PATENT DOCUMENTS

2009/0214273 A1* 8/2009 Ue ..... G03G 15/162 399/302
2012/0039619 A1* 2/2012 Winter ..... G03G 15/6526 399/38
2012/0070160 A1* 3/2012 Aoki ..... G03G 15/652 399/16
2017/0219967 A1* 8/2017 Shimada ..... G03G 15/095

FOREIGN PATENT DOCUMENTS

JP 2003-248361 A 9/2003
JP 2010-152197 A 7/2010

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

An image forming apparatus includes a toner image carrier on which a toner image is formed, a transfer unit that transfers the toner image onto a continuous sheet of paper, a fixing machine that fixes the transferred toner image onto the continuous sheet of paper, a sheet transport unit that transports the continuous sheet of paper through a transport path passing through a transfer position and a fixing position, and an electric charge supply unit that is disposed at a position at which the continuous sheet of paper is placed between the toner image carrier and the electric charge supply unit and that supplies electric charge having an orientation, in which transfer by the transfer unit is prevented, to a toner image present in a region on the toner image carrier, which is out of the continuous sheet of paper.

6 Claims, 4 Drawing Sheets

IMAGE FORMING APPARATUS

CROSS-REFERENCE TO RELATED APPLICATIONS

This application is based on and claims priority under 35 U.S.C. 119 from Japanese Patent Application No. 2016-009490 filed on Jan. 21, 2016.

TECHNICAL FIELD

The present invention relates to an image forming apparatus.

SUMMARY

According to an aspect of the invention, an image forming apparatus is provided. The image forming apparatus includes a toner image carrier on which a toner image is formed to hold the toner image, a transfer unit that transfers, onto a continuous sheet of paper, the toner image on the toner image carrier, a fixing machine that fixes, on the continuous sheet of paper, the toner image transferred onto the continuous sheet of paper, a sheet transport unit that transports the continuous sheet of paper through a transport path passing through a transfer position at which the transfer unit transfers a toner image onto the continuous sheet of paper and a fixing position at which the fixing machine fixes, on the continuous sheet of paper, the toner image on the continuous sheet of paper, and an electric charge supply unit that is disposed upstream of the transfer position in a transport direction of the continuous sheet of paper by the sheet transport unit and at a position at which the continuous sheet of paper is placed between the toner image carrier and the electric charge supply unit, and that supplies electric charge having an orientation, in which transfer by the transfer unit is prevented, to a toner image present in a region on the toner image carrier, which is out of the continuous sheet of paper in a width direction intersecting with the transport direction.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described with reference to the drawings.

Figure 1:
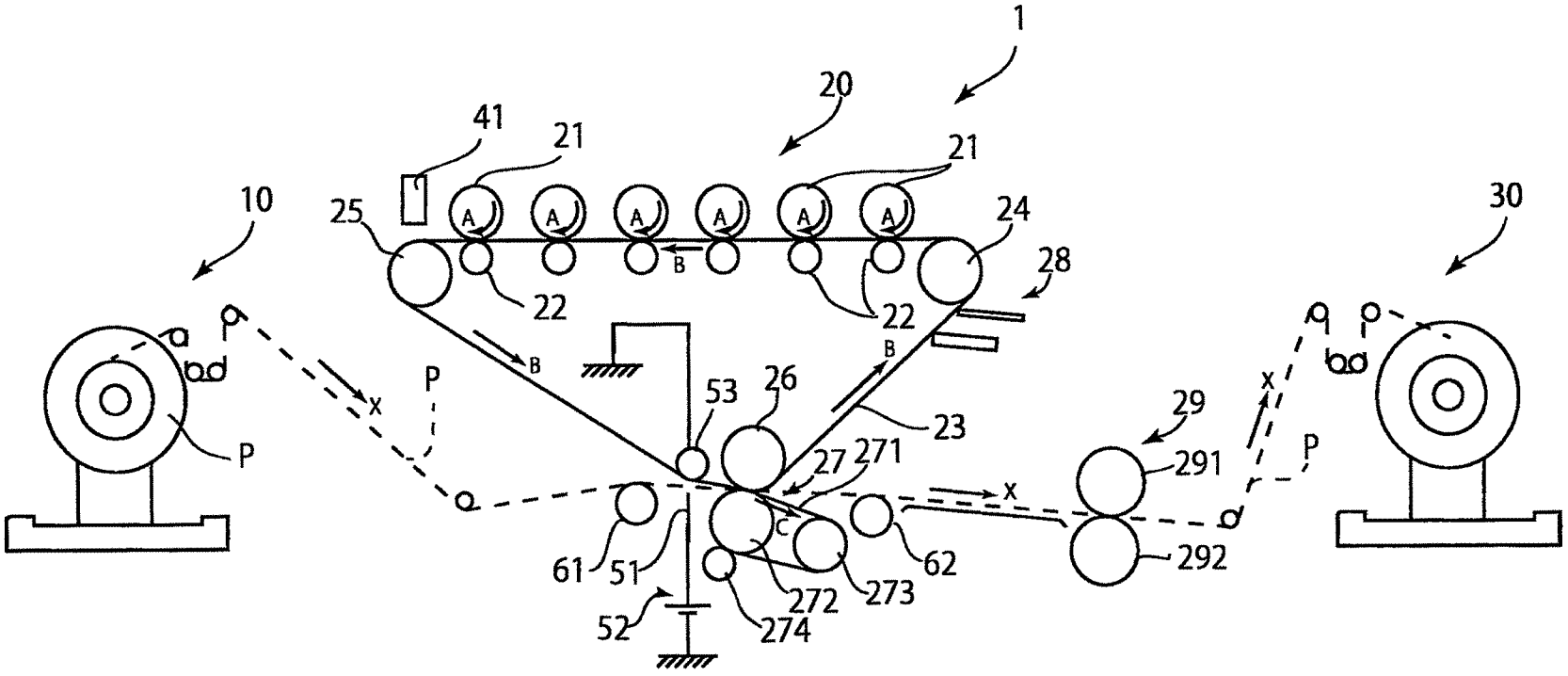
FIG. 1 is a schematic diagram illustrating a configuration of an image forming apparatus as an exemplary embodiment of the invention.

FIG. 1 is a schematic diagram illustrating a configuration of an image forming apparatus 1 according to an exemplary embodiment of the present invention.

The image forming apparatus 1 includes a sheet supply unit 10, an image forming unit 20, and a sheet winding unit 30.

Continuous sheet of paper P wound into a roll shape is mounted on the sheet supply unit 10, and the continuous sheet of paper P is unwound and is continuously supplied to the image forming unit 20. An image is formed on the continuous sheet of paper P supplied to the image forming unit 20 through processes to be described below. The continuous sheet of paper P on which the image is formed by the image forming unit 20 is wound around the sheet winding unit 30 into a roll shape.

Six photoconductors 21 are arranged in an upper portion of the image forming unit 20. A charging unit, an exposure device, a developing device, or the like (not illustrated) is disposed around each of the six photoconductors 21. The photoconductors 21 have a drum shape and a different color toner image is formed on a circumferential surface of each photoconductor 21, while the photoconductors 21 rotate in a direction of arrow A.

An endless intermediate transfer belt 23 is provided below the photoconductors 21 so as to be disposed along the photoconductors 21. The intermediate transfer belt 23 is wound over a driving roll 24, a tension roll 25, and a backing roll 26, is driven by the drive roll 24, and circularly moves in a direction of arrow B.

The respective toner images formed on the respective photoconductors 21 are transferred onto the intermediate transfer belt 23 by operations of the respective primary transfer rolls 22.

The photoconductors 21 and the intermediate transfer belt 23 are examples of a primary holding member and a secondary holding member, respectively. The photoconductors 21, the intermediate transfer belt 23, and a primary transfer roll 22 form an example of a toner image carrier.

A secondary transfer unit 27 is provided at a position at which the intermediate transfer belt 23 and the continuous sheet of paper P are interposed between the backing roll 26 and the secondary transfer unit 27. The secondary transfer unit 27 is an example of a transfer unit.

The secondary transfer unit 27 has a structure in which an endless transfer belt 271 is wound over two rolls 272 and 273, and circularly moves in a direction of arrow C. The toner image on the intermediate transfer belt 23 is transferred onto the continuous sheet of paper P at a transfer position at which the continuous sheet of paper P is in contact with the transfer belt 271 by an operation of the secondary transfer unit 27.

Toner remaining on the intermediate transfer belt 23 after the transfer is removed from the intermediate transfer belt 23 by a cleaner 28.

The toner image transferred onto the continuous sheet of paper P is further transferred in a direction of arrow X, and is fixed on the continuous sheet of paper P by being heated and pressurized while passing through a fixing position interposed between a heater 291 and a pressure device 292 that configure a fixing machine 29. The continuous sheet of paper P, on which an image is formed by the fixing, is wound around the sheet winding unit 30 into a roll shape.

The intermediate transfer belt 23 of the image forming unit 20 has a width wider than the continuous sheet of paper P, and a test pattern 532 (see FIGS. 2 and 3) for adjusting image density or an image forming position is formed with toner in a non-image region 531 (see FIGS. 2 and 3) of the intermediate transfer belt 23, which is out of the continuous sheet of paper P in the width direction. Then, the test pattern 532 on the intermediate transfer belt 23 is read by a sensor 41 and adjustment of the image density or adjustment of the image forming position is performed according to the reading result.

Since the non-image region 531 is a region out of the continuous sheet of paper P, the test pattern formed in the non-image region 531 is aggressively transferred onto the transfer belt 271 by the operation of the secondary transfer unit 27 when there is no method of coping with the transfer. A cleaning brush 274 that removes toner or the like attached on the transfer belt 271 is provided in the secondary transfer unit 27, and it is possible to remove a small amount of attached toner. However, the cleaning brush is not capable of rapidly removing a large amount of toner attached when the test pattern 532 is aggressively transferred. When the toner on the transfer belt 271 is not rapidly removed, there is a concern that the toner, which is not completely removed, will spread from the non-image region around an image region overlapping the continuous sheet of paper P, and a back surface of the continuous sheet of paper P will be smudged when the transfer belt 271 completes a 360-degree round. Thus, in the exemplary embodiment, the transfer of the test pattern formed in the non-image region to the transfer belt 271 is reduced by the following configuration and thereby smudge on the continuous sheet of paper P is prevented.

The image forming unit 20 includes a corotron 51 that eliminates charge from or charges the toner on the intermediate transfer member in a non-contacting manner. The pin corotron 51 is disposed upstream of the transfer position by the secondary transfer unit 27 in a transport direction X of the continuous sheet of paper P and at a position at which the continuous sheet of paper P is placed between the intermediate transfer belt 23 and the pin corotron. The pin corotron 51 has a shape in which plural pin-shaped electrodes 511 (see FIGS. 2 and 3) are arranged in the width direction of the intermediate transfer belt 23. The electrodes 511 may be arranged to a region overlapping the continuous sheet of paper P. The corotron 51 is an example of an electric charge supply unit.

A voltage from a power supply 52 is applied to the pin corotron 51. A ground roll 53, contacting an inner surface of the intermediate transfer belt 23, is disposed such that the continuous sheet of paper P and the intermediate transfer belt 23 are interposed between the ground roll 53 and the pin corotron 51. The ground roll 53 is electrically grounded.

The voltage from the power supply 52 is applied to the pin corotron 51 such that an electric charge having a polarity in an orientation, in which the secondary transfer unit 57 is prevented from performing the transfer to the transfer belt 571, is supplied to the test pattern formed in the region of the intermediate transfer belt 23, which is horizontally out of the continuous sheet of paper P, that is, the non-image region of the intermediate transfer belt, which is out of an image region on the continuous sheet of paper P, on which an image is formed. The continuous sheet of paper P plays a role of a shield from the supply of the electric charge in the image region overlapping the continuous sheet of paper P, and the toner image, which is formed in the image region, is not influenced by the electric charge. Hence, the toner image, which is formed in the image region and is scheduled to be transferred to the continuous sheet of paper P, is transferred onto the continuous sheet of paper P when the continuous sheet of paper P passes through a transfer region in which the intermediate transfer belt 23 and the transfer belt 271 are interposed therein. On the other hand, the test pattern formed in the non-image region on the intermediate transfer belt 23, which is out of the continuous sheet of paper P, is not transferred, but passes through the transfer position. The test pattern, which is not transferred but remains on the intermediate transfer belt 23, is removed from the intermediate transfer belt 23 by the cleaner 28 that removes the remaining toner on the intermediate transfer belt 23. The intermediate transfer belt 23 is made of a hard resin, thus, a blade-shaped cleaner 28 is provided, and the toner on the intermediate transfer belt 23 is removed by a strong force. The transfer belt 271 is made of rubber so as not to excessively press the toner image interposed between the hard intermediate transfer belt 23 and the transfer belt. Therefore, it is not possible to use a cleaner, such as a blade, which is capable of performing strong removal and thus, in the exemplary embodiment, the cleaning brush 274 is used.

A sheet regulating roll 61 is disposed upstream of the pin corotron 51 in the transport direction X described above, and a sheet regulating roll 62 is disposed on the downstream side of the transfer position. The position of the continuous sheet of paper P is regulated by the sheet regulating rolls 61 and 62 during the transport. In addition, an approach angle of the continuous sheet of paper P to the transfer position is stabilized particularly by the sheet regulating roll 61 on the upstream side. Thus, an effect of the continuous sheet of paper P as the shield from the electric charge that is supplied from the pin corotron 51 is stabilized. The sheet regulating roll 61 on the upstream side is an example of a position regulating member.

Figure 2:
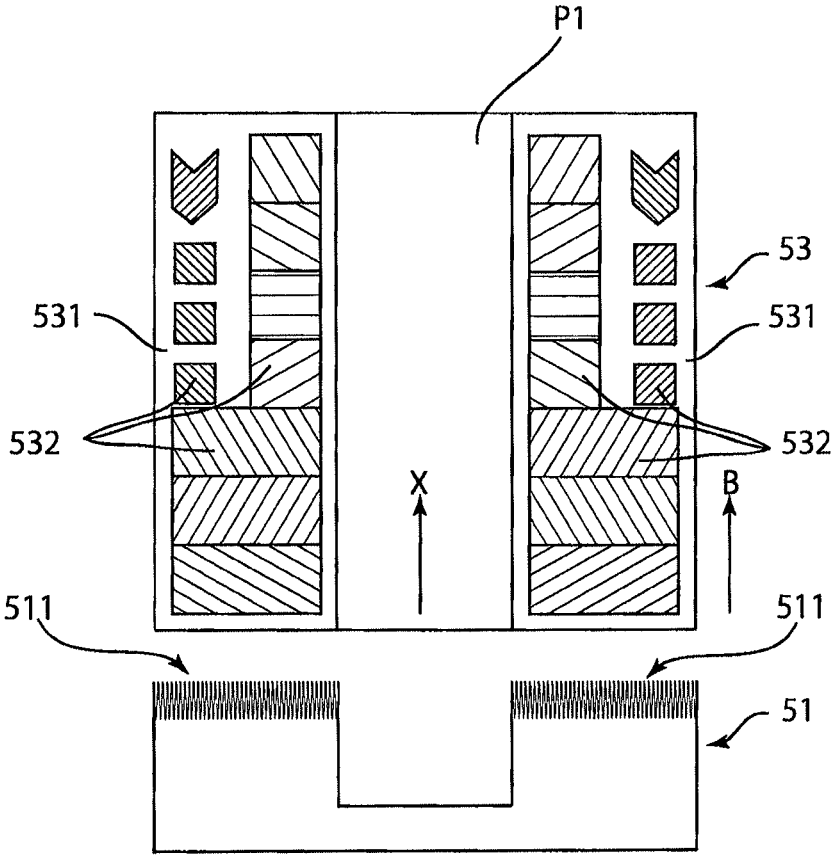
FIG. 2 is a schematic diagram illustrating a shape of a pin corotron and a positional relationship between an intermediate transfer belt and continuous sheet of paper.

FIG. 2 is a schematic diagram illustrating a shape of the pin corotron and a positional relationship between the intermediate transfer belt and the continuous sheet of paper.

The intermediate transfer belt 23 approaches in the direction of arrow B, and the continuous sheet of paper P approaches, in the direction of arrow X as the same direction of the arrow B at the transfer position, the central region of the intermediate transfer belt 23 in the width direction. In FIG. 2, continuous sheet of paper P1 having the minimum width of the continuous sheet of paper P, which can be used in the image forming apparatus 1, is illustrated. Various test patterns 532 are formed in the right and left non-image regions 531 on the intermediate transfer belt 23, which do not overlap the continuous sheet of paper P1.

A plurality of pin-shaped electrodes 511 are arranged in the pin corotron 51 in the width direction in the entire region in the width direction of the intermediate transfer belt 23 except for the region overlapping the continuous sheet of paper P1 having the minimum width. The electric charge from the pin corotron 51 is supplied to the test pattern 532 formed in the non-image region 531 of the intermediate transfer belt 23, which is out of the continuous sheet of paper P, and thus, the test pattern 532 is prevented from being transferred to the transfer belt 271 (see FIG. 1).

Figure 3:
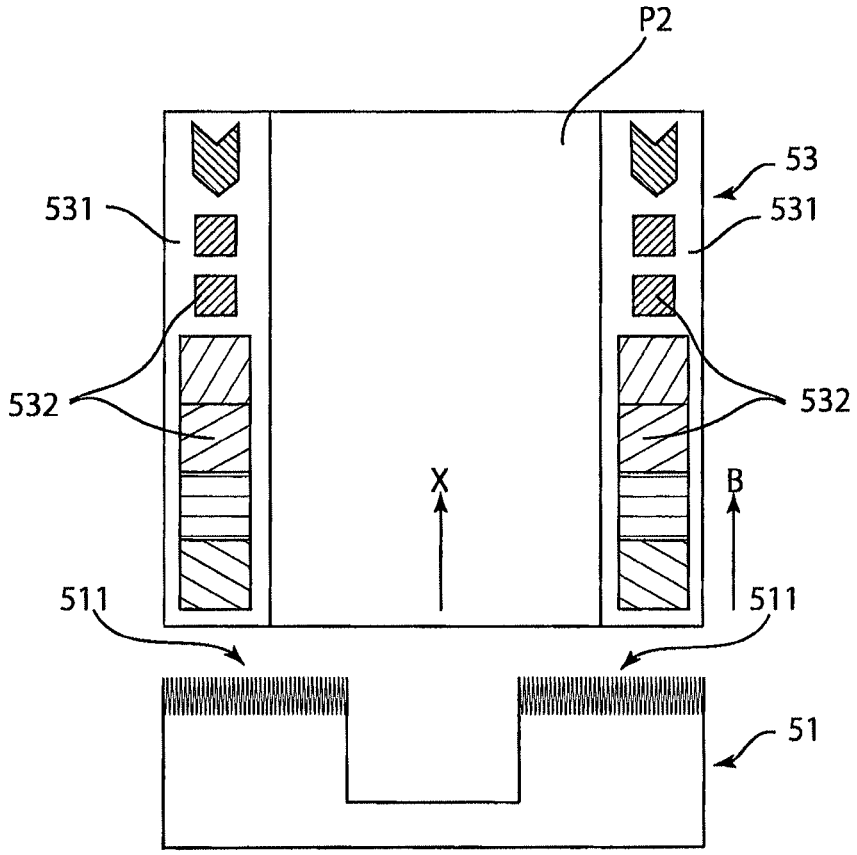
FIG. 3 is a schematic diagram illustrating the shape of the pin corotron and another positional relationship between the intermediate transfer belt and the continuous sheet of paper.

FIG. 3 is a schematic diagram illustrating the shape of the pin corotron and another positional relationship between the intermediate transfer belt and the continuous sheet of paper, similar to FIG. 2.

In FIG. 3, continuous sheet of paper P2 having the maximum width of the continuous sheet of paper P, which can be used in the image forming apparatus 1, is illustrated. Meanwhile, a pin corotron 51 is the same pin corotron as the pin corotron 51 illustrated in FIG. 2.

Also in FIG. 3, similar to FIG. 2, various test patterns 532 are formed in the right and left non-image regions 531 on the intermediate transfer belt 23, which do not overlap the continuous sheet of paper P2. The electric charge is applied to the test pattern 532 by the pin corotron 51. The pin-shaped electrodes 511 are arranged on the pin corotron 51 to a region overlapping the continuous sheet of paper P2; however, the continuous sheet of paper P2 plays the role of the shield from the electric charge, and the electric charge is not supplied to the toner image that is formed in the image region on the intermediate transfer belt 23, which is overlapping the continuous sheet of paper P2. Hence, the toner image, which is formed in the image region, is normally transferred onto the continuous sheet of paper P2.

Figure 4:
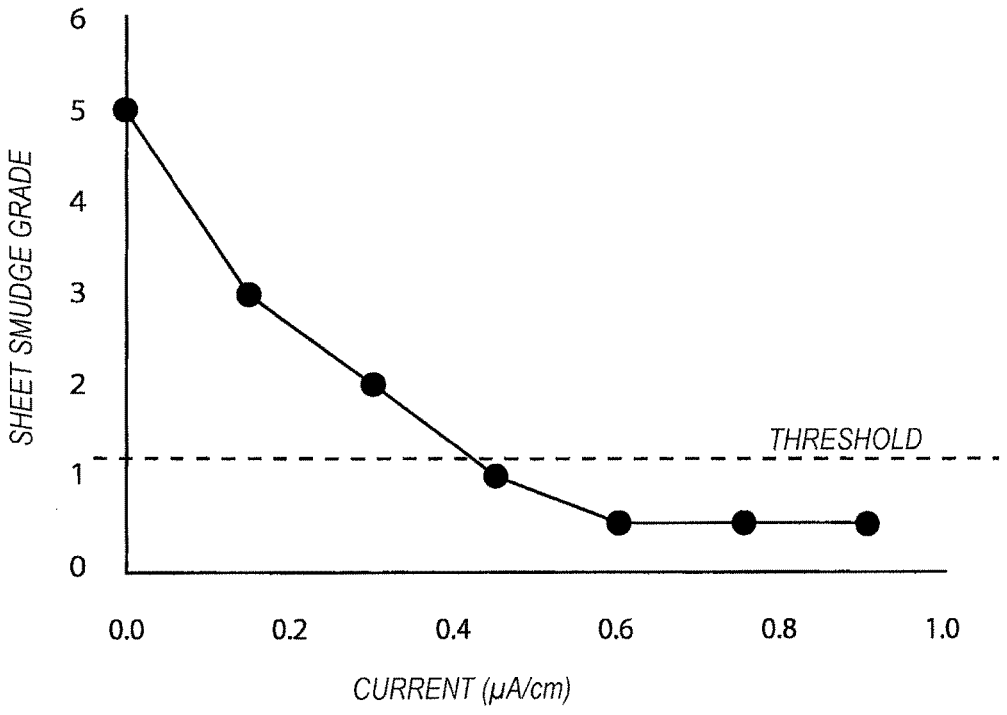
FIG. 4 is a graph illustrating a relationship between a current (horizontal axis) flowing in the pin corotron and a sheet smudge grade (vertical axis).

FIG. 4 is a graph illustrating a relationship between a current (horizontal axis) flowing in the pin corotron and a sheet smudge grade (vertical axis). In the sheet smudge grade on the vertical axis, as a position is higher, a level of smudge is increased. In addition, a threshold value is set at a boundary of whether or not it is possible to visually recognize the smudge.

A hole is punched on an end portion of the continuous sheet of paper P in the with direction, a toner image having 50% of an area ratio is formed in a region on the intermediate transfer belt 23, which corresponds to the hole, a voltage, which is applied to the pin corotron 51, is changed such that a current flowing to the pin corotron 51 is measured, and toner smudge on a back surface of the continuous sheet of paper P at a position after a 360-degree round of the transfer belt 271 from the hole is checked. The operations described above are repeated.

In FIG. 4, when the current value is 0.4 (μA/cm) or higher, it is found that this is a level at which it is not possible to visually recognize the smudge on the back surface of the continuous sheet of paper P. In other words, the pin corotron 51 used in the exemplary embodiment is used, and thereby it is found that it is possible to effectively prevent the smudge on the back surface of the continuous sheet of paper P.

While the pin corotron 51, in which the electrodes 511 are arranged in the region except for the region which is overlapping the continuous sheet of paper P1 (see FIG. 2) having the minimum width, is used in the exemplary embodiment described above, since the continuous sheet of paper P plays the role of the shield from the electric charge, the electrodes 511 may be arranged, for example, over the entire width of the intermediate transfer belt 23, regardless of the width of the continuous sheet of paper P.

In addition, although a so-called pin corotron is used in the exemplary embodiment described above, an electric charge supply unit other than the pin corotron may be used, and the continuous sheet of paper P may play a role of a shield from the electric charge.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner image carrier on which a toner image is formed to hold the toner image;

a transfer unit that transfers, onto a continuous sheet of paper, the toner image on the toner image carrier;

a fixing machine that fixes, on the continuous sheet of paper, the toner image transferred onto the continuous sheet of paper;

a sheet transport unit that transports the continuous sheet of paper through a transport path passing through a transfer position at which the transfer unit transfers a toner image onto the continuous sheet of paper and a fixing position at which the fixing machine fixes, on the continuous sheet of paper, the toner image on the continuous sheet of paper; and an electric charge supply unit that is disposed upstream of the transfer position in a transport direction of the continuous sheet of paper by the sheet transport unit and at a position at which the continuous sheet of paper is placed between the toner image carrier and the electric charge supply unit, and that supplies electric charge having an orientation, in which transfer by the transfer unit is prevented, to a toner image present in a region on the toner image carrier, which is out of the continuous sheet of paper in a width direction intersecting with the transport direction.

2. The image forming apparatus according to claim 1, wherein the electric charge supply unit has a plurality of electrodes that are arranged in the width direction such that the electrodes are allowed to be arranged to a region overlapping the continuous sheet of paper in the width direction.

3. The image forming apparatus according to claim 1, further comprising a position regulating member that regulates a position of the continuous sheet of paper during transport to an upstream side of the electric charge supply unit in the transport direction and that stabilizes an approach angle of the continuous sheet of paper to the transfer position.

4. The image forming apparatus according to claim 1, wherein the toner image carrier includes a primary holding member on which an electrostatic latent image is formed and is developed with toner, and which holds a toner image, and a secondary holding member to which the toner image on the primary holding member is transferred, and which holds the toner image, and the transfer unit transfers, onto the continuous sheet of paper, the toner image on the secondary holding member.

5. The image forming apparatus according to claim 1, further comprising an electrically grounded roll that contacts an inner surface of an intermediate transfer belt, which is the toner image carrier.

6. The image forming apparatus according to claim 1, wherein the electric charge supply unit has a plurality of electrodes that supply the electric charge to an entire region of the toner image carrier except for a region of the carrier that overlaps with the continuous sheet of paper, which has a minimum width that can be used in the image forming apparatus.

* * * * *